US008328313B2

(12) United States Patent
Takeda et al.

(10) Patent No.: US 8,328,313 B2
(45) Date of Patent: Dec. 11, 2012

(54) INKJET RECORDING APPARATUS

(75) Inventors: Kengo Takeda, Inazawa (JP); Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 329 days.

(21) Appl. No.: 12/705,241

(22) Filed: Feb. 12, 2010

(65) Prior Publication Data

US 2010/0245432 A1 Sep. 30, 2010

(30) Foreign Application Priority Data

Mar. 26, 2009 (JP) ..... 2009-075946

(51) Int. Cl.
*B41J 29/38* (2006.01)

(52) U.S. Cl. ..... 347/14; 347/6; 347/5

(58) Field of Classification Search ..... 347/14, 347/5, 6

See application file for complete search history.

(56) References Cited

U.S. PATENT DOCUMENTS

| | | | | |
|---|---|---|---|---|
| 5,912,680 | A * | 6/1999 | Uchida et al. | 347/23 |
| 2002/0097293 | A1* | 7/2002 | Castelli et al. | 347/37 |
| 2006/0214983 | A1* | 9/2006 | Teshima et al. | 347/31 |
| 2007/0257955 | A1* | 11/2007 | Tanaka et al. | 347/21 |
| 2008/0225068 | A1 | 9/2008 | Morino et al. | |

FOREIGN PATENT DOCUMENTS

| | | | |
|---|---|---|---|
| JP | 2001-054949 | A | 2/2001 |
| JP | 2004-130719 | A | 4/2004 |
| JP | 2004-130720 | A | 4/2004 |
| JP | 2004-196505 | A | 7/2004 |
| JP | 2007-054999 | A | 3/2007 |
| JP | 2007-283634 | A | 11/2007 |
| JP | 2008-229921 | A | 10/2008 |

OTHER PUBLICATIONS

Japan Patent Office, Notification of Reason for Refusal for Japanese Patent Application No. 2009-075946 (counterpart to above-captioned patent application), dispatched Feb. 8, 2011.

The State Intellectual Property Office of the People's Republic of China, Notification of First Office Action for Chinese Patent Application No. 201010126436.7 (counterpart to above-captioned patent application), issued Sep. 21, 2011.

* cited by examiner

*Primary Examiner* — Laura Martin
(74) *Attorney, Agent, or Firm* — Baker Botts L.L.P.

(57) ABSTRACT

An inkjet recording apparatus includes at least one inkjet head having an ejection surface, a feeding mechanism which includes a feed member having a feed surface that is opposed to the ejection surface and which drives the feed member to feed a recording medium on the feed surface in a feeding direction, a wiper blade which removes ink that is adhered to the feed surface by contacting the feed surface, a judging portion which judges whether cleaning of the feed surface is necessary, and a controller which controls the at least one inkjet head and the feeding mechanism, in a case where the judging portion judges that the cleaning of the feed surface is necessary, to perform a first operation in which ink is ejected to the feed surface and a second operation in which the feed member is driven.

18 Claims, 4 Drawing Sheets

INKJET RECORDING APPARATUS

CROSS REFERENCE TO RELATED APPLICATION

The present application claims priority from Japanese Patent Application No. 2009-075946, which was filed on Mar. 26, 2009, the disclosure of which is herein incorporated by reference in its entirety.

BACKGROUND OF THE INVENTION

1. Field of the Invention

The present invention relates to an inkjet recording apparatus which performs a recording on a recording medium.

2. Discussion of Related Art

There is known an inkjet recording apparatus which has a feeding mechanism including a feeding member that feeds a recording medium such as paper and at least one inkjet head that ejects ink toward the recording medium fed by the feeding mechanism. In a case where the feeding member is stained with ink because of jamming of the recording medium and so on, cleaning of the feeding member is performed.

There is also known an inkjet recording apparatus in which fluid for cleaning is ejected to a feed belt from a cleaning head, and ink and the cleaning fluid on the feed belt are absorbed by an ink absorbing member.

SUMMARY OF THE INVENTION

There is a problem that a small amount of ink on the feeding member is difficult to be wiped off by a wiper. Further, as described above, in a case where the cleaning head for ejecting the cleaning fluid is provided, it leads to cost increase and structural complexity of the apparatus.

It is therefore an object of the present invention to solve the above-mentioned problems and to provide an inkjet recording apparatus to improve a performance of removal of ink without structural complexity of the apparatus.

According to the present invention, there is provided an inkjet recording apparatus comprising: at least one inkjet head which has an ejection surface for ejecting ink; a feeding mechanism which includes a feed member having a feed surface on a surface thereof that is opposed to the ejection surface and which is configured to drive the feed member so as to feed a recording medium on the feed surface in a feeding direction; a wiper blade which is configured to remove ink that is adhered to the feed surface by contacting the feed surface; a judging portion which is configured to judge whether cleaning of the feed surface is necessary; and a controller which is configured to control the at least one inkjet head and the feeding mechanism, in a case where the judging portion judges that the cleaning of the feed surface is necessary, in order to perform a first operation in which ink is ejected to the feed surface and a second operation in which the feed member is driven.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention with reference to the drawings.

<First Embodiment>

(Mechanical Structure of Inkjet Printer)

Figure 1:
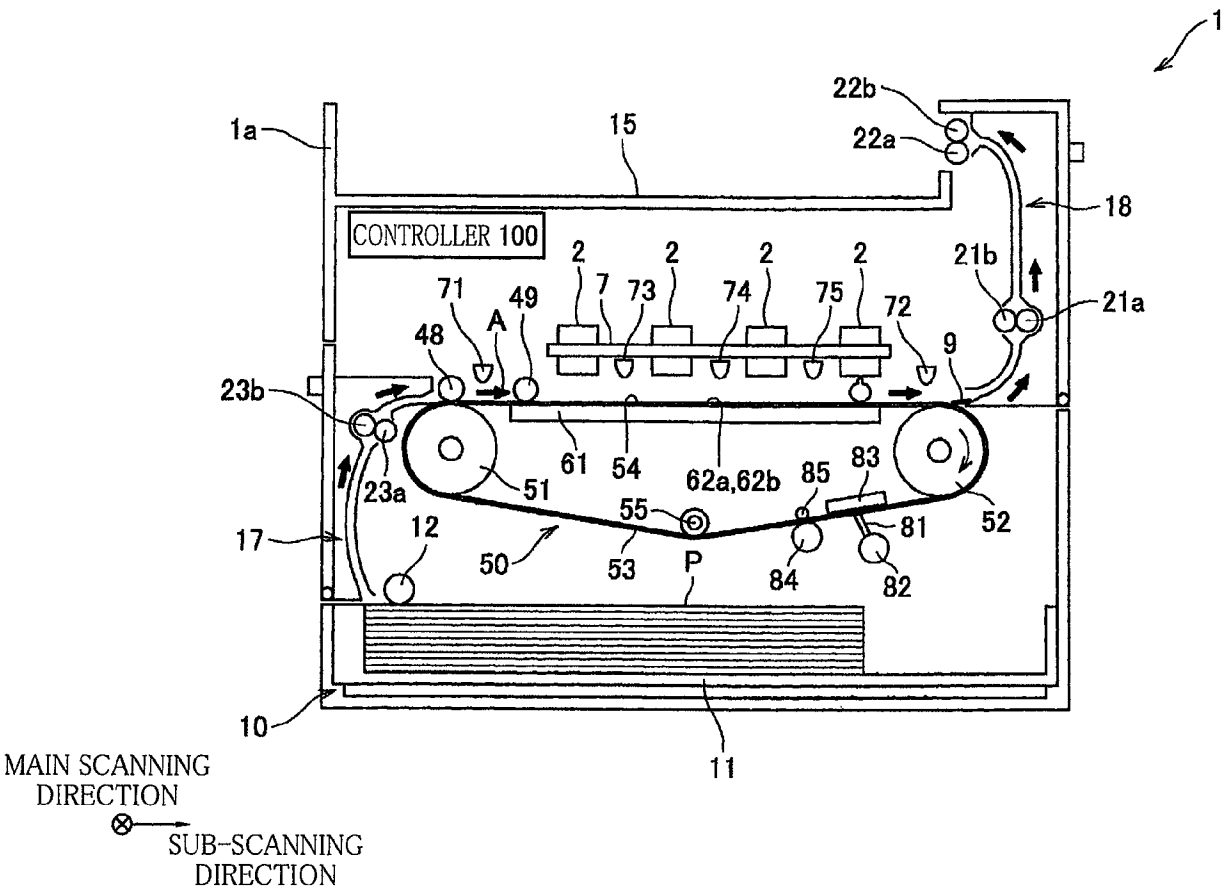
FIG. 1 is a side view schematically showing an internal structure of an inkjet printer as one embodiment to which the present invention is applied.

As shown in FIG. 1, an inkjet printer 1 as a first embodiment of an inkjet recording apparatus is a color inkjet printer which includes a casing 1*a* having a rectangular parallelepiped shape and four inkjet heads 2 which are disposed inside the casing 1*a* and which are arranged to eject respective colors of inks including C (cyan), M (magenta), Y (yellow) and K (black) inks. In the inkjet printer 1, there are provided a sheet-supply device 10 in a lower portion thereof shown in FIG. 1, a sheet-discharge portion 15 in an upper portion thereof shown in FIG. 1, and a feeding mechanism 50 that is disposed between the sheet-supply device 10 and the sheet-discharge portion 15 and that feeds a recording sheet P as a recording medium in a feeding direction A. The inkjet printer 1 also includes a controller 100 that controls various operations of the inkjet printer 1 including the sheet-supply device 10, the sheet-discharge portion 15 and the feeding mechanism 50.

Each of the four inkjet heads 2 has a generally rectangular parallelepiped shape extending in a main scanning direction and is fixed to a frame 7 in a state in which the respective four inkjet heads 2 are arranged to be adjacent to each other in a sub-scanning direction. In other words, the inkjet printer 1 is a line-type printer. In the present embodiment, the sub-scanning direction is a direction parallel to the feeding direction A of the recording sheet P, and the main scanning direction is a direction perpendicular to the sub-scanning direction and extending along a horizontal surface or a direction perpendicular to a sheet plane of FIG. 1.

Figure 2:
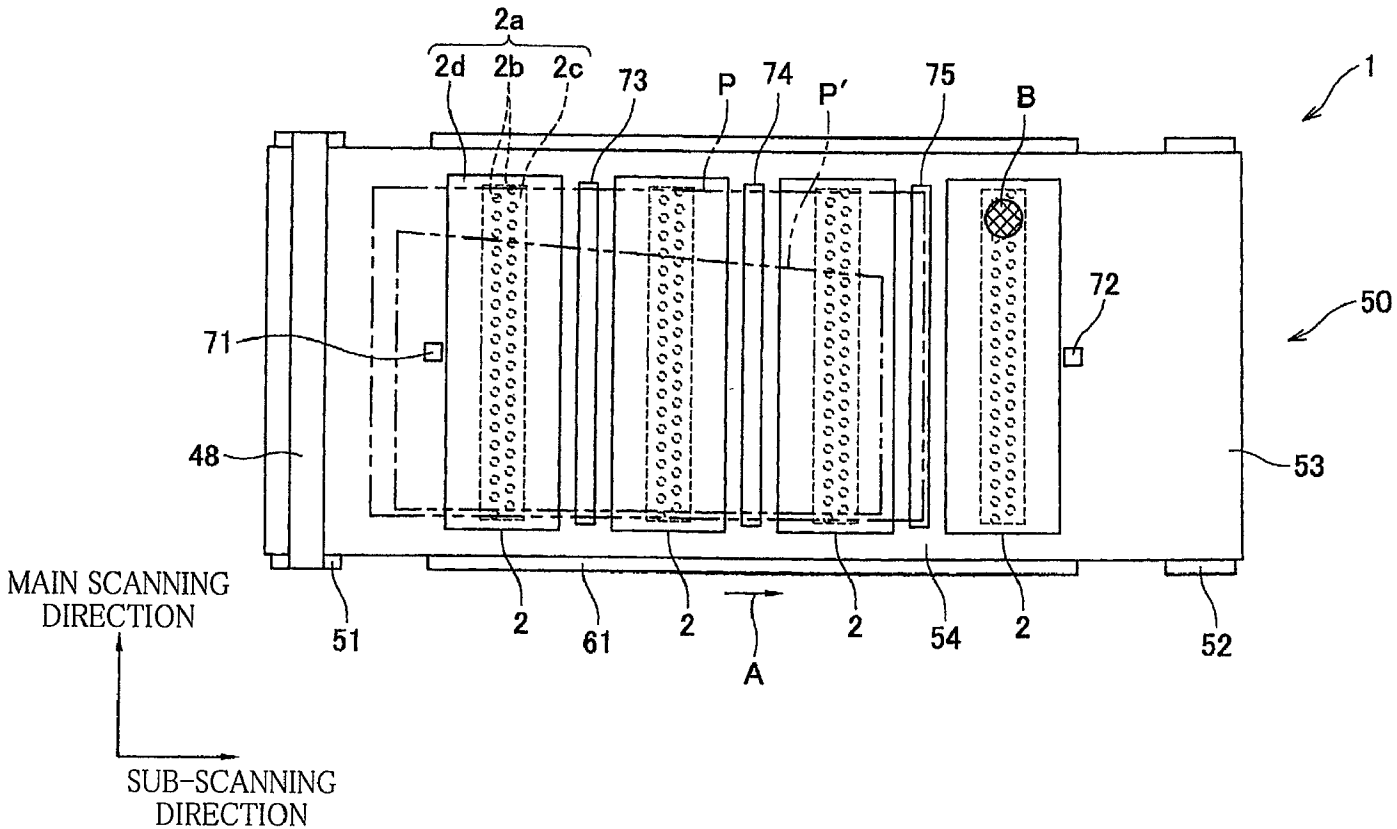
FIG. 2 is a plan view showing four inkjet heads and their vicinity of the inkjet printer shown in FIG. 1.

Each of the inkjet heads 2 has a laminar structure in which a passage unit (not shown) that has an ink passage including a pressure chamber and an actuator (not shown) that applies a pressure on ink in the pressure chamber are stacked on, and adhered to, each other. In a bottom surface of each of the inkjet heads 2, there is formed an ejection surface 2*a* from which ink is ejected. As shown in FIG. 2, in the ejection surface 2*a*, there are formed a plurality of ejection openings 2*b* for ejecting ink, an ejection area 2*c* including the ejection openings 2*b*, and non-ejection area 2*d* by which the ejection area 2*c* is surrounded. The ejection area 2*c* extends slightly longer than the recording sheet P in the main scanning direction, so that the inkjet heads 2 can form an image (or make a borderless printing) on a whole surface (area) of the recording sheet P fed by the feeding mechanism 50.

As shown in FIG. 1, the sheet-supply device 10 includes a sheet-supply cassette 11 which can accommodate a plurality of recording sheets P that are stacked on each other, a sheet-supply roller 12 which supplies or feeds each of the recording sheets P from the sheet-supply cassette 11, and a sheet-supply motor (not shown) which rotates the sheet-supply roller 12. The sheet-supply cassette 11 is arranged to be attachable and detachable in the direction perpendicular to the sheet plane of FIG. 1, and when the sheet-supply cassette 11 is attached to the casing 1*a*, the sheet-supply cassette 11 is positioned at a position where the sheet-supply cassette 11 and the feeding mechanism 50 are aligned with each other in a vertical direction in FIG. 1. The sheet-supply roller 12 is operable to supply an uppermost one of the recording sheets P from the sheet-supply cassette 11 through rotating and contacting the uppermost recording sheet P. The sheet-supply motor for rotating the sheet-supply roller 12 is controlled by the controller 100.

On a left-hand side portion of the inkjet printer 1 in FIG. 1, along a feed path of the recording sheet P between the sheet-supply cassette 11 and the feeding mechanism 50, there are disposed a supply guide 17 which extends in a curved way from the sheet-supply cassette 11 toward the feeding mechanism 50, and a pair of feed rollers 23*a*, 23*b* which is located on a downstream side of the sheet-supply cassette 11 in the feeding direction A. The feed roller 23*b* as a drive roller is driven and rotated by a feed motor (not shown) that is controlled by the controller 100. The feed roller 23*a* is a driven roller and is rotated with feeding of the recording sheet P by the feed roller 23*b*.

In the above-described structure, when the sheet-supply roller 12 is rotated in a clockwise direction in FIG. 1 by control of the controller 100, the recording sheet P that is in contact with the sheet-supply roller 12 is fed upward in FIG. 1 through the supply guide 17, and then is supplied to the feeding mechanism 50, nipped by the pair of feed rollers 23*a*, 23*b*.

The feeding mechanism 50 includes a pair of belt rollers 51, 52, an endless feed belt 53 as a feed member that is wound on the pair of belt rollers 51, 52, a tension roller 55 that applies tension to the feed belt 53, a feed motor (not shown) that rotates the belt roller 52, and a platen 61 having a generally rectangular parallelepiped shape. The pair of belt rollers 51, 52 are arranged to be in parallel with each other in the feeding direction A. The feed belt 53 is opposed to each ejection surface 2*a* of the four inkjet heads 2 and has a feed surface 54 or an outer circumferential surface as a surface for supporting the recording sheet P. The feed belt 53 is formed of a water-repellent material.

The belt roller 52 is a drive roller that is driven by a feed motor (not shown) and rotated in the clockwise direction in FIG. 1. The belt roller 51 is a driven roller that is rotated with circulation of the feed belt 53 by rotation of the belt roller 52 and is rotated in the clockwise direction in FIG. 1. The tension roller 55 is rotatably supported by the casing 1*a* in a state in which the tension roller 55 is in contact with and applies tension to an inner circumferential surface of a lower loop-shaped portion of the feed belt 53, and is rotated in the clockwise direction in FIG. 1 with circulation of the feed belt 53. The platen 61 has a length in the main scanning direction that is slightly larger than those of the recording sheet P and the feed belt 53.

An upper surface of the platen 61 is in contact with an inner circumferential surface of an upper loop-shaped portion of the feed belt 53 so as to support the feed belt 53 from inside. Therefore, the feed surface 54 or an upper surface of the upper loop-shaped portion of the feed belt 53 and the ejection surface 2*a* of each inkjet head 2 are opposed to each other and in parallel with each other, and a small clearance is made between the feed surface 54 and the ejection surface 2*a*. The clearance constitutes a part of a sheet feed path.

On an upstream side of one of the four inkjet heads 2 that is located on a most upstream side in the feeding direction A and at a position that is opposite to the belt roller 51, the pressure roller 48 is disposed. The pressure roller 48 is biased against the feed surface 54 by an elastic member (not shown) such as a spring so as to press the recording sheet P that is supplied from the sheet-supply device 10 against the feed surface 54. The pressure roller 48 is a driven roller that is rotated with circulation of the feed belt 53.

Further, on an upstream side of the inkjet head 2 that is located on the most upstream side in the feeding direction A and a downstream side of the pressure roller 48 in the feeding direction A, and at a position that is opposite to the platen 61, a pressure roller 49 is disposed. The pressure roller 49 is biased against the feed surface 54 by an elastic member (not shown) such as a spring so as to press the recording sheet P against a position that is opposite to a predetermined position of the feed surface 54 and indirectly press the recording sheet P against the platen 61. Therefore, the recording sheet P can be easily electrostatically adsorbed by a pair of comb electrodes 62*a*, 62*b* described later. The pressure roller 49 is a driven roller that is rotated with circulation of the feed belt 53.

Furthermore, the pair of comb electrodes 62*a*, 62*b* are disposed on the upper surface of the platen 61, and the upper surface thereof is coated with a protecting layer to protect the upper surface thereof from wear (abrasion) caused by contact with the feed belt 53. Each of the pair of comb electrodes 62*a*, 62*b* is disposed along the feeding direction A and has a plurality of electrode portions (parallel electrode portions) that are consecutively formed in the main scanning direction, and the electrode portions of one of the comb electrodes 62*a*, 62*b* and the electrode portions of the other of the comb electrodes 62*a*, 62*b* are alternately arranged in the main scanning direction. When voltage is applied between the pair of comb electrodes 62*a*, 62*b* from a power source 63 (shown in FIG. 3), adjacent electrode portions of the comb electrodes 62*a*, 62*b* function as a capacitor to pass through a clearance between the electrode portions of the comb electrodes 62*a*, 62*b* and the feed belt 53, the feed belt 53, a clearance between the feed belt 53 and the recording sheet P, and the recording sheet P. When tiny current flows into the adjacent electrode portions to charge the capacitor, electric field is produced. Adsorptive (adsorption) power based on Johnsen-Rahbeck effect is thus produced, and the recording sheet P on the feed belt 53 is electrostatically adsorbed to the feed surface 54 because of the adsorptive power. The power source 63 from which voltage is applied between the pair of comb electrodes 62*a*, 62*b* is controlled by the controller 100.

In this structure, when the belt roller 52 is rotated in the clockwise direction in FIG. 1 by control of the controller 100, the feed belt 53 is circulated. With circulation of the feed belt 53, the belt roller 51, the tension roller 55, the pressure roller 48, and the pressure roller 49 are also rotated. At the time, by control of the controller 100, since voltage is applied between the pair of comb electrodes 62*a*, 62*b*, tiny current to charge the capacitor consisting of the adjacent electrode portions of the comb electrodes 62*a*, 62*b* flows into the adjacent electrode portions, so that Johnsen-Rahbeck effect (the adsorptive power) occurs. Therefore, the recording sheet P that is supplied from the sheet-supply device 10 is fed in the feeding direction A in a state in which the recording sheet P is electrostatically adsorbed to the feed surface 54. Further, at the time, when the recording sheet P that is kept on and fed on the feed surface 54 of the feed belt 53 passes right below the four inkjet heads 2 in order, the controller 100 controls each of the four inkjet heads 2 to eject respective colors of inks toward the recording sheet P, so that a desired color image is formed on the recording sheet P.

Further, between the belt roller 52 and the tension roller 55, there is disposed a wiper blade 81 which is contactable with an outer circumferential surface of the lower loop-shaped portion of the feed belt 53 and removes ink that is stuck to or adhered to the outer circumferential surface of the feed belt 53 in a case where the wiper blade 82 contacts the outer circumferential surface of the lower loop-shaped portion of the feed belt 53. A dimension or a width of the wiper blade 81 that is measured in the main scanning direction is smaller than a width of the feed belt 53 in the main scanning direction.

The wiper blade 81 is connected to a wiper moving mechanism 82 or a wiper moving device. The wiper moving mechanism 82 is movable in a vertical direction in FIG. 1 by control of the controller 100 so as to have the wiper blade 81 in a state of being distant from the feed belt 53 come into contact with the feed belt 53 and have the wiper blade 81 in a state of contact with the feed belt 53 move away from the feed belt 53.

Furthermore, between the belt roller 52 and the tension roller 55, there is disposed a contact plate 83 which is held in contact with an inner circumferential surface of the lower loop-shaped portion of the feed belt 53. The contact plate 83 supports the wiper blade 81 from an inner circumferential side of the feed belt 53 when the wiper blade 81 contacts the feed belt 53, so that ink stuck to the outer circumferential surface of the feed belt 53 can be preferably removed by the wiper blade 81.

In the above-mentioned structure, in a case where the controller 100 determines that cleaning of the (outer circumferential) surface of the feed belt 53 is necessary, by control of the controller 100, at first, the wiper blade 81 in the state of being distant from the feed belt 53 comes into contact with the outer circumferential surface of the lower loop-shaped portion of the feed belt 53 and the feed belt 53 is circulated once or at one revolution (one turn). As the feed belt 53 is circulated, ink to be removed that is adhered to the surface of the feed belt 53, in terms of a direction of circulation of the feed belt 53, is gathered to a small area of the surface of the feed belt 53 that is located in the vicinity of a contact point with the wiper blade 81. The gathered ink falls in drops from the surface of the feed belt 53 under its weight and is collected by an ink-collecting member (not shown). The ink to be removed that is adhered to the surface of the feed belt 53 is thus removed by the wiper blade 81. In this case, the ink that is gathered to a small area of the surface of the feed belt 53 that is located in the vicinity of a contact point with the wiper blade 81, in terms of a direction perpendicular to the direction of circulation of the feed belt 53, i.e., the main scanning direction (a widthwise direction of the wiper blade 81 or a direction perpendicular to the sheet plane of FIG. 1), gradually extends along the wiper blade 81. Therefore, an amount of the gathered ink in the direction of circulation of the feed belt 53 varies with the elapse of time. The circulation amount of the feed belt 53 is not limited to one revolution.

As mentioned above, when the cleaning is performed, the wiper blade 81 in the state of being distant from the feed belt 53 comes into contact with the feed belt 53, and when no cleaning is performed, the wiper blade 81 moves away from the feed belt 53, so that, load on the feed belt 53, which is caused by contacting of the wiper blade 81 with the feed belt 53 when the feed belt 53 is circulated, can be reduced.

Further, when the cleaning is performed by the wiper blade 81, by control of the controller 100, from one of the four inkjet heads 2 that ejects one color of ink (in the present embodiment, yellow ink) that is the closest in brightness to a white color of the recording sheet P, i.e., the least visible relative to the recording sheet P, out of the four colors of inks such as cyan, magenta, yellow and black inks, the yellow ink is ejected to the feed surface 54, the yellow ink having an amount that is equal to or greater than 0.1 ml per 100 mm of a width of the wiper blade 81 in the main scanning direction. In the present embodiment, the inkjet head 2 that ejects the yellow ink is located on a most downstream side of the four inkjet heads 2 corresponding to the four colors of inks in the feeding direction A.

As the feed belt 53 is circulated, the yellow ink that is ejected from the inkjet head 2 to the feed surface 54, in addition to the ink to be removed that is adhered to the surface of the feed belt 53, is gathered to the small area of the surface of the feed belt 53 that is located in the vicinity of the contact point with the wiper blade 81 in terms of the direction of circulation of the feed belt 53. While the ink is gathered by the wiper blade 81, the amount of the ink per unit area that is adhered to the feed belt 53 is equal to or greater than a predetermined amount that is a minimum amount per unit area necessary for the ink adhered to the feed belt 53 to have the surface tension. That is, the predetermined amount is a minimum amount per unit area necessary for ink on the feed surface to have the surface tension such that the ink is removable from the feed surface. When the ink is removed by the wiper blade 81 by circulation of the feed belt 53, because of the surface tension occurred in the ink, the ink can be removed more favorably, compared to a case where a small amount of ink is removed. Further, since the ink that is ejected by the inkjet head 2 is used for the cleaning of the feed belt 53, it is unnecessary to have fluid exclusively used for the cleaning. Therefore, performance of removal of ink can be improved without structural complexity of the inkjet printer 1.

Further, before the ink, which is adhered to the feed belt 53, is removed by the wiper blade 81, the amount of ink that is equal to or greater than 0.1 ml per 100 mm of the width of the wiper blade 81 in the main scanning direction is ejected to the feed belt 53. Therefore, there is empirically a high possibility that the ink of the amount that is equal to or greater than the predetermined amount per unit area is ejected to the feed belt 53, so that the ink can be preferably removed by the wiper blade 81.

Furthermore, since the yellow ink out of the four colors of inks (C, M, Y and K inks) that is the least visible relative to the white color of the recording sheet P is used for the cleaning, even in a case where the recording sheet P is stained with ink because all the ink cannot be removed by the wiper blade 81, a stain on the recording sheet P can be less visible.

Furthermore, because the inkjet head 2 that ejects the yellow ink is located on the most downstream side of the four inkjet heads in the feeding direction A, when the feed belt 53 is circulated in the feeding direction A until a point where the yellow ink is ejected is moved to an area where the wiper blade 81 is located, a circulation amount of the feed belt 53 can be reduced, compared to a case where the inkjet head 2 that ejects the yellow ink is located on a upstream side in the feeding direction A.

Furthermore, because the feed belt 53 is formed of a water-repellent material, the ink that is adhered to the feed belt 53 can be easily removed by the wiper blade 81.

When the ink is gathered to the small area of the surface of the feed belt 53 that is located in the vicinity of the contact point with the wiper blade 81, the ink gradually extends along the wiper blade 81 in terms of the direction perpendicular to the direction of circulation of the feed belt 53. Accordingly, the amount of the gathered ink in the direction of circulation of the feed belt 53 varies with the elapse of time. Therefore, in order that the adhered ink on the surface of the feed belt 53 is favorably removed by the wiper blade 81, it is desirable that an amount of ink that is ejected from the inkjet head 2 to the feed surface 54 is determined, in consideration of a point where the ink is ejected, such that the amount of the gathered ink in the direction of circulation of the feed belt 53 is equal to or greater than the predetermined amount per unit area that is the minimum amount per unit area necessary for ink on the feed belt 53 to have the surface tension to such an extent that the ink is removable from the feed belt 53, continuously until a time point when the ink to be removed that is adhered to the surface of the feed belt 53 and the ejected ink from the inkjet head 2 to the feed surface 54 become integral. It is also desirable, in view of reduction of the amount of the ejected ink, that the point where the ink is ejected from the inkjet head 2 coincides with a point of the ink to be removed that is adhered to the surface of the feed belt 53.

Between the belt roller 52 and the tension roller 55 and on a side of the tension roller 55 of the wiper blade 81, there is disposed a cleaning roller 84 as an ink absorbing member which is contactable with the outer circumferential surface of the lower loop-shaped portion of the feed belt 53 and which absorbs the ink adhered to the surface of the feed belt 53 in a case where the cleaning roller 84 contacts the outer circumferential surface of the lower loop-shaped portion of the feed belt 53. A width of the cleaning roller 84 measured in the main scanning direction is made smaller than the width of the feed belt 53 in the main scanning direction and larger than the width of the wiper blade 81 in the main scanning direction.

The cleaning roller 84 is connected to a roller moving mechanism, not shown. The roller moving mechanism is operated by control of the controller 100 to move the cleaning roller 84 in the vertical direction in FIG. 1 so as to be able to have the cleaning roller 84 in a state of being distant from the feed belt 53 contact the feed belt 53 and the cleaning roller 84 in a state of being in contact with the feed belt 53 move away from the feed belt 53.

Further, between the belt roller 52 and the tension roller 55 and on a side of the tension roller 55 of the contact plate 83, there is disposed a contact roller 85 which is in contact with the inner circumferential surface of the lower loop-shaped portion of the feed belt 53. Because the contact roller 85 supports the cleaning roller 84 from an inner circumferential side of the feed belt 53 when the cleaning roller 84 contacts the feed belt 53, the ink adhered to the surface of the feed belt 53 is preferably absorbed by the cleaning roller 84.

In the above-described structure, after the cleaning is performed by the wiper blade 81, by control of the controller 100, the wiper blade 81 moves away from the feed belt 53, and then the cleaning roller 84 in the state of being distant from the feed belt 53 contacts the outer circumferential surface of the lower loop-shaped portion of the feed belt 53 and the feed belt 53 is circulated at one revolution. Accordingly, ink that cannot be removed by the wiper blade 81, especially ink that is positioned outside respective ends of the wiper blade 81 as a result of gradually extending along the wiper blade 81 in terms of the direction perpendicular of the direction of circulation of the feed belt 53 and ink that is gathered at the contact point of the wiper blade 81 with the feed belt 53, is absorbed by the cleaning roller 84. The circulation amount of the feed belt 53 is not limited to the one revolution.

In the present embodiment, since the ink that cannot be removed by the wiper blade 81 is absorbed by the cleaning roller 84, the performance of ink removal can be further improved.

Cases where the controller 100 judges that the cleaning should be performed includes a case where a predetermined time has passed since a start of printing, a case where a number of printed recording sheets P reaches a predetermined number, a case where a jamming of the recording sheet P occurs, a case where a predetermined time has passed since a power source is turned on, and so on.

Between the pressure roller 48 and the inkjet heads 2 and on a downstream side of one of the inkjet heads 2 that is located on a most downstream side in the feeding direction A, there are respectively disposed two sensors 71, 72 that are arranged such that respective detection surfaces of the sensors 71, 72 are opposed to the feed surface 54. The sensors 71, 72 are reflective optical sensors that detect the recording sheet P by reflection of light on a surface of the recording sheet P and located at respective positions that are opposed to a middle of the feed surface 54 in the main scanning direction. The sensors 71, 72 detect a leading end of the recording sheet P that is fed by the feed belt 53. The sensors 71, 72 are not limited to reflective optical sensors, and may be transmissive optical sensors and so forth.

In a case where the sensor 72 does not detect the leading end of the recording sheet P after a predetermined time has passed since the sensor 71 detects the leading end of the recording sheet P, the controller 100 judges that the jamming of the recording sheet P occurs on the feeding mechanism 50. In this case, the controller 100 controls to stop the circulation of the feed belt 53 and ink ejection by the inkjet heads 2.

Further, as shown in FIG. 1, between the two inkjet heads 2 adjacent to each other, there are respectively disposed CISs (Contact Image Sensors) 73, 74, 75, each of which is an example of a position detecting portion and has a detecting surface that are opposed to the feed surface 54. The CISs 73, 74, 75 are reflective optical sensors that detect the recording sheet P by reflection of light on a surface of the recording sheet P. As shown in FIG. 2, each of the CISs 73, 74, 75 has generally the same width as the width of the inkjet head 2 in the main scanning direction.

In a case where the controller 100 judges that the jamming of the recording sheet P occurs on the feeding mechanism 50, the CISs 73, 74, 75 detect a position of the recording sheet P on the feed surface 54 in the main scanning direction. Results of detection by the CISs 73, 74, 75 are used by the controller 100 for estimating a position of the ink to be removed that is adhered to the feed surface 54. The controller 100 calculates an amount of ink per unit area that is ejected to the estimated position of ink by a time when each inkjet head 2 stops the ink ejection, and judges whether the amount of ink per unit area is equal to or greater than a predetermined amount of ink. In a case where the calculated amount of ink per unit area is not equal to or greater than the predetermined amount of ink, after the recording sheet P in which the jamming occurs is removed from the feeding mechanism 50 by a user, the controller 100 controls that the inkjet head 2 ejects ink to the same position as the estimated position of ink in the main scanning direction, so that the amount of ink per unit area at the same position as the estimated position of ink in the main scanning direction is made equal to or greater than the predetermined amount of ink. The controller 100 then controls such that the cleaning is performed by the wiper blade 81. For example, as shown in FIG. 2, in a case where the jammed recording sheet P' is leaned to a lower side of the feed surface 54 in FIG. 2, based on the results of detection by the CISs 73, 74, 75, the controller 100 estimates that ink is adhered to an upper side on the feed surface 54 in FIG. 2 and calculates the amount of ink per unit area that is ejected to the estimated position of ink. The controller 100 then determines whether the calculated amount of ink per unit area is equal to or greater than the predetermined amount of ink. In a case where the calculated amount of ink per unit area is not equal to or greater than the predetermined amount of ink, the controller 100 controls the inkjet head 2 that is located on the most downstream side in the feeding direction A to eject ink to a position B that is located on the upper side of the feed surface 54 in FIG. 2 such that an amount per unit area of ink on the upper side of the feed surface 54 along the direction of circulation of the feed belt 53, i.e., a total of the amount of ink that has been adhered to the feed surface 54 before the occurrence of jamming and the amount of ink that is ejected from the inkjet head 2 after the occurrence of jamming, becomes equal to or greater than the predetermined amount of ink. Therefore, since the ink that is adhered to the upper side of the feed belt 53 in FIG. 2 has the surface tension to such an extent that the ink is removable from the feed belt 53, the ink adhered to the feed surface 54 can be preferably removed by the wiper blade 81.

As mentioned above, because the position of ink that is adhered to the feed surface 54 is estimated based on the position of the recording sheet P in the main scanning direction and the ink is ejected to the same position of the feed surface 54 as the estimated position of ink in the main scanning direction, the ink that is adhered to the feed belt 53 is favorably removed by the wiper blade 81.

On the other hand, the controller 100 judges that the jamming of the recording sheet P occurs on the feeding mechanism 50, estimates the position of ink to be removed that is adhered to the feed surface 54, and calculates the amount of ink that is ejected to the estimated position of ink by the time point when each inkjet head 2 stops the ink ejection, and as a result, in a case where the controller 100 determines that the calculated amount of ink is equal to or greater than the predetermined amount of ink, no ink is ejected from the inkjet head 2. The controller 100 controls the wiper blade 81 to perform the cleaning, so that the ink that is equal to or greater than the predetermined amount of ink can be favorably removed.

As shown in FIG. 1, right on a downstream side of the feeding mechanism 50 in the feeding direction A, there is disposed a separate plate 9. The separate plate 9 separates the recording sheet P from the feed surface 54 when an end of the separate plate 9 is inserted between the recording sheet P and the feed belt 53.

In a feed path between the feeding mechanism 50 and the sheet-discharge portion 15, there are disposed four feed rollers 21*a*, 21*b*, 22*a*, 22*b* and a discharge guide 18 that is located between the feed rollers 21*a*, 21*b* and the feed rollers 22*a*, 22*b* along the feed path. The feed rollers 21*b*, 22*b* is driven and rotated by a feed motor (not shown) that is controlled by the controller 100. The feed rollers 21*a*, 22*a* are driven rollers and rotated with feeding of the recording sheet P.

In this structure, by control of the controller 100, the feed motor is driven such that the feed rollers 21*b*, 22*b* are rotated and the recording sheet P that is discharged from the feeding mechanism 50 is fed through the discharge guide 18 and upward in FIG. 1, nipped by the feed rollers 21*a*, 21*b*. The recording sheet P is then discharged to the sheet-discharge portion 15, nipped by the feed rollers 22*a*, 22*b*.

(Electric Structure of Inkjet Printer)

Figure 3:
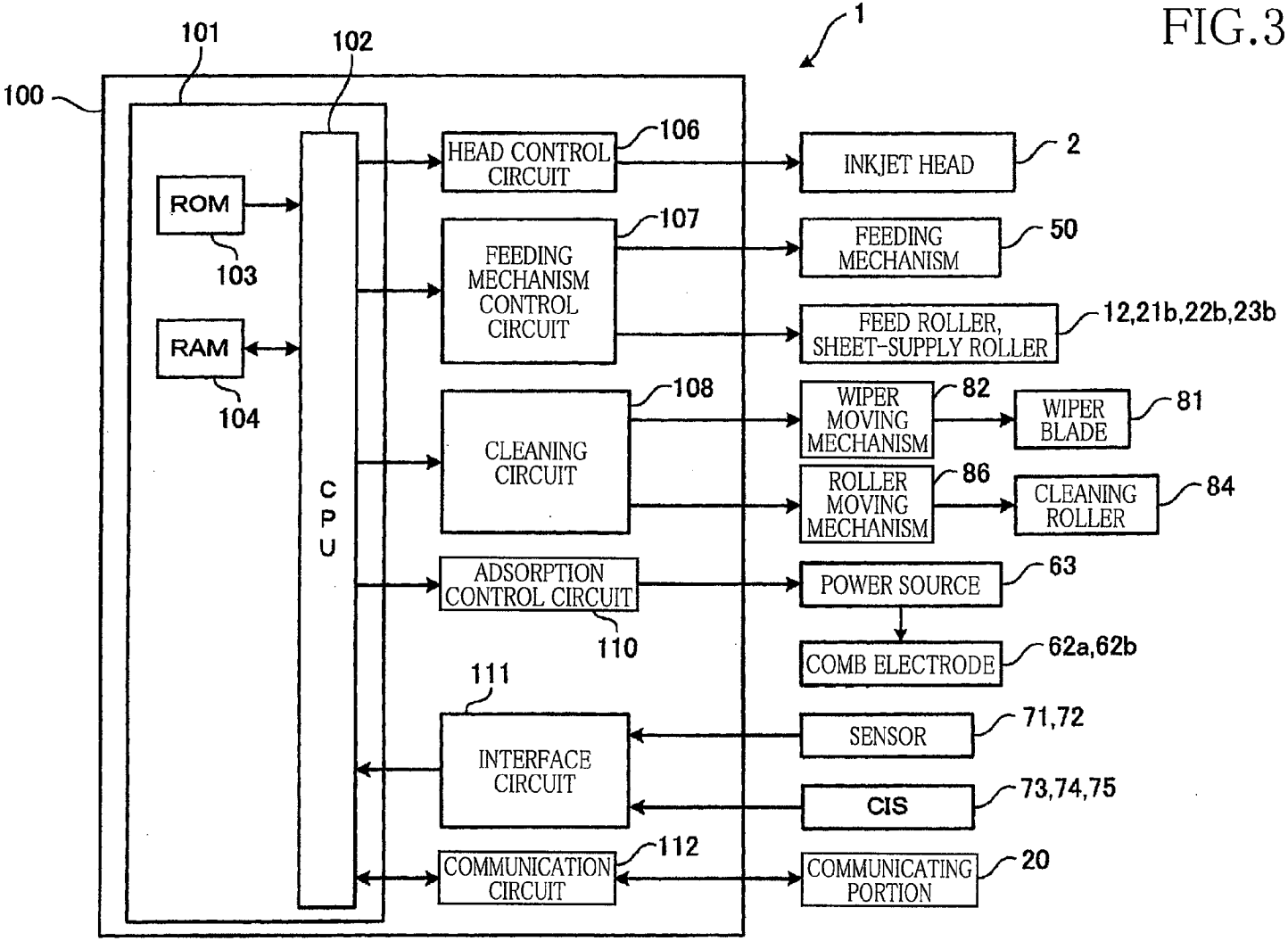
FIG. 3 is a view showing an electric structure of the inkjet printer.

As shown in FIG. 3, various operations of the inkjet printer 1 are controlled by the controller 100. The controller 100 mainly consists of a microcomputer 101 that is disposed on a circuit board and also includes various circuits. The microcomputer 101 includes a CPU (Central Processing Unit) 102 that executes control operations based on predetermined control programs, a ROM (Read Only Memory) 103 where various programs are stored, and a RAM (Random Access Memory) 104 as a temporary storing device.

The CPU 102 is connected to and controls a head control circuit 106 that controls the inkjet heads 2, a feeding mechanism control circuit 107 that controls the feeding mechanism 50, the feed rollers 21*b*, 22*b*, 23*b*, and the sheet-supply roller 12, a cleaning control circuit 108 that controls the wiper moving mechanism 82 and the roller moving mechanism 86, respectively, such that the cleaning is performed by the wiper blade 81 and the cleaning roller 84, an adsorption control circuit 110 that controls the power source 63 for applying voltage between the pair of comb electrodes 62*a*, 62*b*, an interface circuit 111 where sheet detection signals from the sensors 71, 72 and the CISs 73, 74, 75 are inputted, and a communication circuit 112 that communicates with a general-purpose personal computer (not shown) and so forth via a communicating portion 20. The CPU 102, the head control circuit 106, the feeding mechanism control circuit 107 and the cleaning control circuit 108 constitutes a controller or a control portion.

The head control circuit 106 controls each inkjet head 2 so as to eject ink toward the recording sheet P, based on print data transmitted from the general-purpose personal computer and so forth via the communicating portion 20. In the present embodiment, the head control circuit 106 controls each inkjet head 2 such that the ink ejection to the recording sheet P starts after a predetermined time has passed since the sensor 71 detects the leading end of the recording sheet P that is fed by the feeding mechanism 50. The predetermined time is a time obtained by dividing a feed speed of the recording sheet P into a distance along the feed path from the leading end of the recording sheet P when the sensor 71 detects the leading end thereof, to one of ejection openings or nozzles, which is located on a most upstream side in the feeding direction A, of one of the inkjet heads 2 that is located on a most upstream side in the feeding direction A.

The head control circuit 106 controls the inkjet head 2 to eject ink to the feed surface 54 when the cleaning is performed. The head control circuit 106 also controls the inkjet head 2, in the case where the jamming of the recording sheet P occurs on the feeding mechanism 50 and the amount of ink that is ejected to the estimated position of ink by the time when each inkjet head 2 stops the ink ejection is not equal to or greater than the predetermined amount of ink, to eject ink to the same position of the feed surface 54 as the position thereof in the main scanning direction where it is estimated that the ink is adhered.

The feeding mechanism control circuit 107 controls the feeding mechanism 50, the feed rollers 21*b*, 22*b*, 23*b*, and the sheet-supply roller 12 such that the recording sheet P is fed from the sheet-supply device 10 to the sheet-discharge portion 15. The feeding mechanism control circuit 107 also controls the feeding mechanism 50 to circulate the feed belt 53 when the cleaning is performed.

The cleaning control circuit 108 controls the wiper moving mechanism 82 and the roller moving mechanism 86 such that the wiper blade 81 and the cleaning roller 84 are in contact with the feed belt 53 when the cleaning is performed, and the wiper blade 81 and the cleaning roller 84 are distant from the feed belt 53 when no cleaning is performed.

The adsorption control circuit 110 controls the power source 63 to apply voltage between the pair of comb electrodes 62*a*, 62*b*.

The CPU 102 as a judging portion judges whether the cleaning is necessary. Further, in the case where the jamming of the recording sheet P occurs on the feeding mechanism 50, the CPU 102 estimates the position of the ink that is adhered to the feed surface 54 based on the results of detection by the CISs 73, 74, 75, and calculates the amount of ink that is ejected to the estimated position of the ink by the time when each inkjet head 2 stops the ink ejection.

(Operations of Inkjet Printer)

Hereinafter, operations of the inkjet printer 1 will be described with reference to a flow chart of a cleaning process routine illustrated in FIG. 4.

(Cleaning Process Routine)

Figure 4:
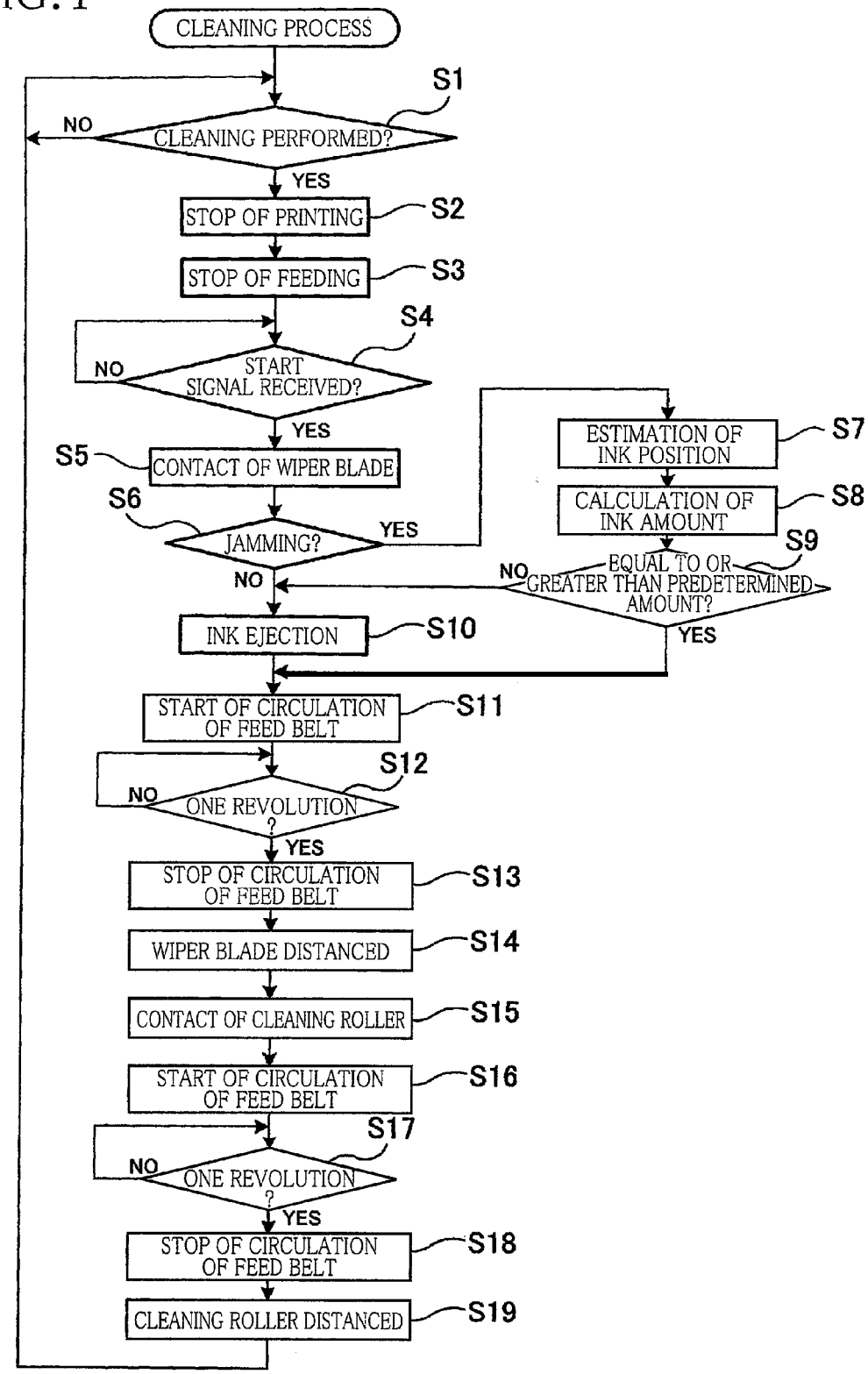
FIG. 4 is a flow chart illustrating a cleaning process routine.

As shown in FIG. 4, when the cleaning process routine is implemented, it is determined whether the cleaning is performed (step S1). In a case where it is determined that the cleaning is not performed (S1: NO), implementation of the cleaning process is returned to step S1. On the other hand, in a case where it is determined that the cleaning is performed (S1: YES), the head control circuit 106 controls the inkjet heads 2 to stop a printing operation (step S2), and the feeding mechanism control circuit 107 controls the feeding mechanism 50, the feed rollers 21*b*, 22*b*, 23*b* and the sheet-supply roller 12 to stop a feeding operation of the recording sheet P (step S3).

Next, in step S4, it is determined whether a start signal is received. In the present embodiment, in a case where the cleaning is performed after the jamming is managed by the user, the start signal is transmitted by receiving a jamming-management end signal in which management of the jamming by the user is finished. In a case where the cleaning is performed under other conditions, the start signal is transmitted after the feeding of the recording sheet P is stopped. In a case where it is determined that the start signal is not received (S4: NO), the receipt of the start signal is waited by repeatedly implementing of step S4. On the other hand, in a case where it is determined that the start signal is received (S4: YES), the cleaning control circuit 108 controls the wiper moving mechanism 82 such that the wiper blade 81 in the state of being distant from the feed belt 53 contacts the outer circumferential surface of the feed belt 53 (step S5).

As described above, when the cleaning is performed, the wiper blade 81 in the state of being distant from the feed belt 53 contacts the feed belt 53, and when the cleaning is not performed, the wiper blade 81 is distant from the feed belt 53, so that load on the feed belt 53, which is caused by contacting of the wiper blade 81 with the feed belt 53 when the feed belt 53 is circulated, can be reduced.

Next, in step S6, it is determined whether the jamming occurs. In a case where it is determined that the jamming occurs (S6: YES), based on the results of detection by the CISs 73, 74, 75, the position of the ink that is adhered to the feed surface 54 is estimated (step S7 as an example of an ink-position estimating portion). In step S8 as an example of an adhered-ink-amount calculating portion, the amount per unit area of the ink that is ejected to the estimated position of the ink by the time when the ink ejection from each inkjet head 2 is stopped is calculated, and then, in step S9 as an example of a necessity determining portion, it is determined whether the calculated amount of the ink is equal to or greater than the predetermined amount of ink.

In a case where it is determined that the jamming does not occur in step S6 (S6: NO), or in a case where it is determined that the calculated amount of the ink is not equal to or greater than the predetermined amount of ink in step S9 (S9: NO), the yellow ink is ejected from the corresponding inkjet head 2 to the feed surface 54 (step S10). In the case where it is determined that the jamming occurs, in step S10, ink is ejected to the same position as the estimated position of the ink in the main scanning direction. It is satisfactory that the amount of the ink that is ejected from the inkjet head 2 is equal to or greater than the amount necessary for ink on the feed belt 53 to have the surface tension to such an extent that the ink is removable from the feed belt 53, and a total of the amount of the ejected ink and the amount of the ink adhered to the feed belt 53 is equal to or greater than the predetermined amount that is the minimum amount per unit area for ink on the feed belt 53 to have the surface tension to such an extent that the ink is removable from the feed belt 53. Therefore, in a case where the amount of the ejected ink is equal to or greater than the predetermined amount of ink (i.e., an amount of ink such that the predetermined amount of ink per unit area is adhered to the feed belt 53), since the amount of the ejected ink and the amount of the ink adhered to the feed belt 53 are added up together, the amount of ink per unit area can be equal to or greater than the predetermined amount of ink, so that the ink can be surely removed from the feed belt 53. Further, in a case where the amount of the ink that the inkjet head 2 ejects is equal to or greater than 0.1 ml per 100 mm of the width of the wiper blade 81 in the main scanning direction, there is a high possibility that the amount of the ink per unit area is equal to or greater than the predetermined amount of ink.

As mentioned above, the ink that is equal to or greater than the predetermined amount of ink is ejected from the inkjet head 2 to the feed belt 53. In this case, when the feed belt 53 is circulated and the wiper blade 81 removes the ink from the feed belt 53, the ink on the feed belt 53 can be removed more favorably, compared to a case where a small amount of ink is removed. Further, since the cleaning of the feed belt 53 is performed by use of the ink that is ejected by the inkjet head 2, it is unnecessary to have fluid exclusively used for cleaning. Therefore, the performance of removal of ink can be improved without structural complexity of the inkjet printer 1.

Further, before the ink, which is adhered to the feed belt 53, is removed by the wiper blade 81, the ink of the amount that is equal to or greater than 0.1 ml per 100 mm of the width of the wiper blade 81 in the main scanning direction is ejected to the feed belt 53. Therefore, there is empirically a high possibility that the ink of the amount that is equal to or greater than the predetermined amount of ink is ejected to the feed belt 53, so that the ink can be preferably removed by the wiper blade 81.

Furthermore, in the case of jamming, the position of the adhered ink on the feed surface 54 is estimated based on the position of the recording sheet P in the main scanning direction, and the ink is ejected to the same position as the estimated position of the adhered ink on the feed surface 54 in the main scanning direction, so that the ink that is adhered to the feed belt 53 can be favorably removed by the wiper blade 81.

Furthermore, since the yellow ink of the four colors of inks (C, M, Y and K inks) that is the least visible relative to the white color of the recording sheet P is used for the cleaning, even in a case where the recording sheet P is stained with ink because all the ink cannot be removed by the wiper blade 81, a stain on the recording sheet P can be less visible.

After step S10 is implemented, or in a case where it is determined that the calculated amount of ink is equal to or greater than the predetermined amount of ink in step S9, the circulation of the feed belt 53 is started in step S11. Accordingly, the ink that is adhered to the surface of the feed belt 53 is removed by the wiper blade 81.

In step S11, because the inkjet head 2 that ejects the yellow ink is located on the most downstream side in the feeding direction A, when the feed belt 53 is circulated in the feeding direction A until a point where the yellow ink is ejected is moved to an area where the wiper blade 81 is located, a circulation amount of the feed belt 53 can be reduced, compared to a case where the inkjet head 2 that ejects the yellow ink is located on a upstream side in the feeding direction A.

Further, because the feed belt 53 is formed of a water-repellent material, the ink that is adhered to the feed belt 53 can be easily removed by the wiper blade 81.

Step S5 may be implemented after implementation of step S10 or step S11. Step S11 may be implemented before implementation of step S5 or step S10. The steps may be implemented in the order of steps S11, S6, S10 and S5.

In step S12, it is determined whether the feed belt 53 is circulated at one revolution. In a case where it is determined that the feed belt 53 is not circulated at one revolution (S12: NO), step S12 is repeatedly implemented until the feed belt 53 is circulated at one revolution. On the other hand, in a case where it is determined that the feed belt 53 is circulated at one revolution (S12: YES), the circulation of the feed belt 53 is stopped (step S13), and the wiper blade 81 moves away from the feed belt 53 (step S14).

Next, the cleaning roller 84 in the state of being distant from the feed belt 53 contacts the outer circumferential surface of the feed belt 53 (step S15), and then the circulation of the feed belt 53 is started (step S16). Accordingly, ink that is adhered to the surface of the feed belt 53, especially ink that is positioned outside respective ends of the wiper blade 81 as a result of gradually extending along the wiper blade 81 in terms of the direction perpendicular of the direction of circulation of the feed belt 53 and ink that is gathered at the contact point of the wiper blade 81 with the feed belt 53, is absorbed by the cleaning roller 84. Steps S13 and S16 may be omitted. In other words, while the feed belt 53 continues to be circulated, the wiper blade 81 may move away from the feed belt 53 and the cleaning roller 84 may contact the feed belt 53.

As described above, since the ink that cannot be removed by the wiper blade 81 is absorbed by the cleaning roller 84, the performance of ink removal can be further improved.

The order of implementation of steps S15 and S16 is not limited to the present embodiment, the steps may be implemented in the reverse order to the present embodiment, i.e. in the order of step S16 and then step S15, or steps S15 and S16 may be concurrently implemented. Next, in step S17, it is determined whether the feed belt 53 is circulated at one revolution. In a case where it is determined that the feed belt 53 is not circulated at one revolution (S17: NO), step S17 is repeatedly implemented until it is determined that the feed belt 53 is circulated at one revolution. On the other hand, in a case where it is determined that the feed belt 53 is circulated at one revolution (S17: YES), the circulation of the feed belt 53 is stopped in step S18 and the cleaning roller 84 moves away from the feed belt 53 in step S19, and then implementation of the cleaning process is returned to step S1.

<Second Embodiment>

(Mechanical Structure of Inkjet Printer)

Hereinafter, an inkjet printer as a second embodiment to which the present invention is applied will be described. The inkjet printer as the second embodiment is different from the inkjet printer 1 as the first embodiment in which, when the cleaning is performed, instead of ink ejection to the feed surface 54 by only the inkjet head 2 that ejects the yellow ink, the inkjet head 2 having the largest remaining amount of ink ejects the ink to the feed surface 54. For example, in a case where the remaining amount of ink of one inkjet head 2 that ejects the magenta ink is greater than the remaining amount of ink of each of the other inkjet heads 2, when the cleaning is performed, the inkjet head 2 corresponding to the magenta ink ejects the ink to the feed surface 54.

The controller 100 accumulatively stores data on the amount of ink that each of the inkjet heads 2 ejects, so that the controller 100 acquires the total amount of ink that each of the inkjet heads 2 has ejected for a time period since a new ink cartridge is set in each inkjet head 2 up to the present. Therefore, the controller 100 can specify the inkjet head 2 having the smallest total amount of ink that is ejected as the inkjet head 2 having the largest remaining amount of ink. Alternatively, a sensor may be disposed for measuring weight of the ink cartridge set in each inkjet head 2, and the controller 100 may specify the inkjet head 2 in which the ink cartridge having the heaviest weight is set as the inkjet head 2 having the largest remaining amount of ink. In the second embodiment, though the cleaning process shown in FIG. 4 is implemented, in step S10, the controller 100 controls that the ink is ejected to the feed surface 54 from the inkjet head 2 having the largest remaining amount of ink.

As described above, since the ink having the largest remaining amount is used for cleaning, a replacement frequency of ink cartridges that accommodate ink can be decreased.

Because the other components are structured in the same way as the first embodiment, description thereof is omitted.

(Modified Embodiments)

The present invention is not limited to the illustrated embodiments. It is to be understood that the present invention may be embodied with various changes and modifications that may occur to a person skilled in the art, without departing from the spirit and scope of the invention defined in the appended claims.

For example, though, in the illustrated embodiments, the wiper blade 81 is moved away from the feed belt 53 by the wiper moving mechanism 82, the wiper blade 81 may be constantly in contact with the feed belt 53. The same can be applied to the cleaning roller 84.

In the illustrated embodiments, when the cleaning is performed, the amount of the ink that is ejected to the feed surface 54 is not limited to the amount that is equal to or greater than 0.1 ml per 100 mm of the width of the wiper blade 81 in the main scanning direction.

In the first embodiment, the inkjet head 2 that ejects ink to the feed surface 54 for the cleaning is not limited to the inkjet head 2 that ejects the yellow ink. For example, in a case where the inkjet head 2 that ejects the cyan ink is located on the most downstream side in the feeding direction A, the cyan ink may be ejected to the feed surface 54 during the cleaning. Further, it is not necessary that the inkjet head 2 that ejects ink to the feed surface 54 during the cleaning is located on the most downstream side in the feeding direction A. For example, even in a case where the inkjet head 2 that ejects the yellow ink is located on the most upstream side in the feeding direction A, the yellow ink may be ejected to the feed surface 54 during the cleaning.

The illustrated embodiments may be structured without the CISs 73, 74, 75.

In the illustrated embodiments, the feed belt 53 may not be formed of a water-repellent material.

In the illustrated embodiments, the cleaning by the wiper blade 81 and the cleaning by the cleaning roller 84 may be performed simultaneously, instead of being performed individually.

In the illustrated embodiments, the cleaning by the cleaning roller 84 is always performed after the cleaning by the wiper blade 81. Alternatively, the cleaning by the cleaning roller 84 may be performed after the cleaning by the wiper blade 81 is performed at plural times.

The illustrated embodiments may be structured without the cleaning roller 84.

The inkjet recording apparatus according to the present invention is not limited to an inkjet type, and is applicable to a thermal-type recording apparatus. The inkjet recording apparatus is not limited to a line-type, and is applicable to a serial-type recording apparatus whose head is reciprocateable. Further, the present invention is not limited to a printer, and is applicable to a facsimile, a copier and so on. Furthermore, though the feeding mechanism 50 in the illustrated embodiments feeds the recording sheet P in a horizontal direction, the feed surface 54 that is parallel to the ejection surface 2*a* may be arranged in an inclined way relative to the horizontal direction such that the recording sheet P can be fed in a direction other than the horizontal direction (e.g., a slanting direction or a vertical direction).

In the first embodiment, the position of the recording sheet P is detected by the CISs 73, 74, 75 and the position of the adhered ink on the feed surface 54 based on the position of the recording sheet P is estimated, and the present invention is not limited to this structure, for example, the position of the adhered ink on the feed surface 54 may be specified by using an image sensor which can directly detect the position of the ink on the surface of the feed surface 54. In this case, in addition to the position of the ink that is adhered to the feed surface 54 due to the jamming, the position of the ink that is adhered to the feed surface 54 caused by other factors such as a borderless printing can be specified, so that the ink on the feed surface 54 can be surely removed.

In the illustrated embodiments, the inkjet printer 1 including four inkjet heads 2 that eject colors of inks that are different from each other is described as an example to which the present invention is applied. The present invention is also applicable to, for example, an inkjet printer including one inkjet head that ejects black ink. In this case, in a case where cleaning of a feed belt is necessary, the black ink is ejected toward the feed belt, and the ink is removed by a wiper blade.

In the illustrated embodiment, when the cleaning is performed, ink (the yellow ink) is ejected from one inkjet head, and the present invention is not limited to this structure, for example, a plurality of inkjet heads may concurrently eject inks. Accordingly, the inks can be ejected quickly, so that the cleaning process can be executed promptly.

What is claimed is:

1. An inkjet recording apparatus comprising:

a plurality of inkjet heads that are configured to eject colors of inks that are different from each other, each of the plurality of inkjet heads comprising an ejection surface for ejecting ink;

a feeding mechanism which comprises a feed member having a feed surface on a surface thereof that is opposed to the ejection surface and which is configured to drive the feed member so as to feed a recording medium on the feed surface in a feeding direction;

a wiper blade which is configured to remove ink that is adhered to the feed surface by contacting the feed surface;

a judging portion which is configured to judge whether cleaning of the feed surface is necessary; and a controller which is configured to control the plurality of inkjet heads and the feeding mechanism, when the judging portion judges that the cleaning of the feed surface is necessary, in order to perform a first operation in which ink is ejected to the feed surface and a second operation in which the feed member is driven, wherein, in the first operation, the controller controls the plurality of inkjet heads such that one of the plurality of inkjet heads ejects ink of a color closest in brightness to a color of the recording medium, and wherein the one of the plurality of inkjet heads that ejects ink of the color closest in brightness to the color of the recording medium is located on a most downstream side of the plurality of inkjet heads in the feeding direction.

2. The inkjet recording apparatus according to claim 1, further comprising a wiper moving mechanism which is configured to be allowed to have the wiper blade in a state of being distant from the feed surface contact the feed surface and to have the wiper blade in a state of being in contact with the feed surface move away from the feed surface, and wherein, in addition to the first and the second operations, the controller controls the wiper moving mechanism to perform a third operation to have the wiper blade in the state of being distant from the feed surface contact the feed surface.

3. The inkjet recording apparatus according to claim 1, wherein the at least one inkjet head comprises an inkjet head which is configured to eject a yellow ink, and wherein, in the first operation, the controller controls the at least one inkjet head such that the inkjet head corresponding to the yellow ink ejects the ink.

4. The inkjet recording apparatus according to claim 1, wherein at least the surface of the feed member is formed of a water-repellent material.

5. The inkjet recording apparatus according to claim 1, further comprising an ink absorbing member which is located on a downstream side in the feeding direction of a position where the wiper blade is provided and which is configured to absorb ink adhered to the feed surface.

6. The inkjet recording apparatus according to claim 1, wherein the controller comprises:

an adhered-ink-amount calculating portion which is configured to calculate an amount of ink adhered to the feed surface; and a necessity determining portion which is configured to determine whether the first operation is performed, based on the amount of adhered ink calculated by the adhered-ink-amount calculating portion.

7. An inkjet recording apparatus comprising:

at least one inkjet head which has an ejection surface for ejecting ink;

a feeding mechanism which comprises a feed member having a feed surface on a surface thereof that is opposed to the ejection surface and which is configured to drive the feed member so as to feed a recording medium on the feed surface in a feeding direction;

a wiper blade which is configured to remove ink that is adhered to the feed surface by contacting the feed surface;

a judging portion which is configured to judge whether cleaning of the feed surface is necessary; and a controller which is configured to control the at least one inkjet head and the feeding mechanism, when the judging portion judges that the cleaning of the feed surface is necessary, in order to perform a first operation in which ink is ejected to the feed surface and a second operation in which the feed member is driven, wherein, in the first operation, the controller controls the at least one inkjet head to eject the ink of an amount that is equal to or greater than 0.1ml per 100mm of a width of the wiper blade in a direction perpendicular to the feeding direction.

8. The inkjet recording apparatus according to claim 7, further comprising a wiper moving mechanism which is configured to be allowed to have the wiper blade in a state of being distant from the feed surface contact the feed surface and to have the wiper blade in a state of being in contact with the feed surface move away from the feed surface, and wherein, in addition to the first and the second operations, the controller controls the wiper moving mechanism to perform a third operation to have the wiper blade in the state of being distant from the feed surface contact the feed surface.

9. The inkjet recording apparatus according to claim 7, wherein the at least one inkjet head comprises a plurality of inkjet heads which are configured to eject colors of inks that are different from each other, and wherein, in the first operation, the controller controls the plurality of inkjet heads such that one of the plurality of inkjet heads that ejects ink of a color closest to a color of the recording medium ejects the ink.

10. The inkjet recording apparatus according to claim 7, wherein, in the first operation, the controller controls the plurality of inkjet heads such that one of the plurality of inkjet heads that ejects ink of a color closest in brightness to the color of the recording medium ejects the ink.

11. The inkjet recording apparatus according to claim 7, wherein the at least one inkjet head comprises an inkjet head which is configured to eject a yellow ink, and wherein, in the first operation, the controller controls the at least one inkjet head such that the inkjet head corresponding to the yellow ink ejects the ink.

12. The inkjet recording apparatus according to claim 7, wherein the one of the plurality of inkjet heads that ejects ink of the color closest to the color of the recording medium is located on a most downstream side of the plurality of inkjet heads in the feeding direction.

13. The inkjet recording apparatus according to claim 7, wherein at least the surface of the feed member is formed of a water-repellent material.

14. The inkjet recording apparatus according to claim 7, further comprising an ink absorbing member which is located on a downstream side in the feeding direction of a position where the wiper blade is provided and which is configured to absorb ink adhered to the feed surface.

15. The inkjet recording apparatus according to claim 7, wherein the controller comprises:

an adhered-ink-amount calculating portion which is configured to calculate an amount of ink adhered to the feed surface; and a necessity determining portion which is configured to determine whether the first operation is performed, based on the amount of adhered ink calculated by the adhered-ink-amount calculating portion.

16. An inkjet recording apparatus comprising:

at least one inkjet head which has an ejection surface for ejecting ink;

a feeding mechanism which comprises a feed member having a feed surface on a surface thereof that is opposed to the ejection surface and which is configured to drive the feed member so as to feed a recording medium on the feed surface in a feeding direction;

a wiper blade which is configured to remove ink that is adhered to the feed surface by contacting the feed surface;

a judging portion which is configured to judge whether cleaning of the feed surface is necessary;

a controller which is configured to control the at least one inkjet head and the feeding mechanism, when the judging portion judges that the cleaning of the feed surface is necessary, in order to perform a first operation in which ink is ejected to the feed surface and a second operation in which the feed member is driven;

an ink-position detecting portion configured to detect a position of ink adhered to the feed surface in a direction perpendicular to the feeding direction, wherein the controller controls the at least one inkjet head to eject ink toward the same position on the feed surface in the direction perpendicular to the feeding direction as the position of ink adhered to the feed surface that is detected by the ink-position detecting portion.

17. The inkjet recording apparatus according to claim 16, wherein the ink-position detecting portion has a detecting surface that are opposed to the feed surface and is a optical sensor extending in a direction perpendicular to the feeding direction.

18. The inkjet recording apparatus according to claim 16, wherein the ink-position detecting portion comprises a position detecting portion which is configured to detect a position of the recording medium on the feed surface in the direction perpendicular to the feeding direction, and wherein the ink-position detecting portion detects the position of ink adhered to the feed surface based on the position of the recording medium on the feed surface detected by the position detecting portion.

* * * * *